US008421324B2

(12) United States Patent
Nasu et al.

(10) Patent No.: US 8,421,324 B2
(45) Date of Patent: Apr. 16, 2013

(54) SPARK PLUG, METAL SHELL FOR SPARK PLUG, AND METHOD OF MANUFACTURING SPARK PLUG

(75) Inventors: Hiroaki Nasu, Gifu (JP); Akito Sato, Obu (JP); Kazuhiro Kodama, Hekinan (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 13/583,389

(22) PCT Filed: Sep. 16, 2010

(86) PCT No.: PCT/JP2010/005655

§ 371 (c)(1), (2), (4) Date: Sep. 7, 2012

(87) PCT Pub. No.: WO2011/111128

PCT Pub. Date: Sep. 15, 2011

(65) Prior Publication Data

US 2013/0002120 A1 Jan. 3, 2013

(30) Foreign Application Priority Data

Mar. 10, 2010 (JP) ..... 2010-052451

(51) Int. Cl.
*H01T 13/20* (2006.01)

(52) U.S. Cl.
USPC ..... 313/141; 313/118

(58) Field of Classification Search ..... 313/141, 313/118
See application file for complete search history.

(56) References Cited

U.S. PATENT DOCUMENTS

| | | | | |
|---|---|---|---|---|
| 6,366,008 | B1 | 4/2002 | Fukushima et al. | |
| 8,106,572 | B2 * | 1/2012 | Tanaka et al. | 313/141 |
| 2002/0041135 | A1 | 4/2002 | Fukushima et al. | |
| 2003/0168955 | A1 | 9/2003 | Suzuki | |

FOREIGN PATENT DOCUMENTS

| | | | |
|---|---|---|---|
| JP | 2002-184552 | A | 6/2002 |
| JP | 2003-257583 | A | 9/2003 |
| JP | 2007-023333 | A | 2/2007 |
| JP | 2007-141868 | A | 6/2007 |
| JP | 2007-270356 | A | 10/2007 |

OTHER PUBLICATIONS

International Search Report mailed Dec. 21, 2010 for the corresponding PCT Application No. PCT/JP2010/005655.
Notice of Allowance of the corresponding Japanese Application No. 2010-052451 mailed Mar. 15, 2011.

* cited by examiner

*Primary Examiner* — Vip Patel
(74) *Attorney, Agent, or Firm* — Leason Ellis LLP

(57) ABSTRACT

Provided is a spark plug that is excellent not only in salt resistance but also in stress corrosion cracking resistance. The spark plug includes a metal shell covered by a composite layer including a nickel plating layer and a chromate layer formed on the nickel plating layer. The chromate layer has a film thickness of 2 to 45 nm and Cr element concentration of not more than 60 at % and contains Ni in addition to Cr.

11 Claims, 7 Drawing Sheets

1: METAL SHELL
1d: SWAGED PORTION
1e: HEXAGON PORTION
1f: GAS SEAL PORTION
1h: GROOVE PORTION

FIG. 4

EFFECTS OF FILM THICKNESS AND Cr WEIGHT OF CHROMATE LAYER

| | SAMPLE No. | S01 | S02 | S03 | S04 | S05 | S06 | S07 | S08 | S9 | S10 | S11 | S12 (REFERENCE EXAMPLE) |
|---|---|---|---|---|---|---|---|---|---|---|---|---|---|
| CHROMATE PROCESSING CONDITION | BICHROMATE CONCENTRATION (g/L) | 10 | 40 | | | | | | | | | | 34 |
| | PROCESSING TIME (min.) | 5 | 5 | | | | | | | | | | 1.5 |
| | PROCESSING TEMPERATURE (°C) | 35 | 35 | | | | | | | | | | 30 |
| | CATHODE CURRENT DENSITY (A/dm2) | 0.1 | 0.005 | 0.01 | 0.02 | 0.05 | 0.1 | 0.2 | 0.4 | 0.45 | 0.5 | 1.0 | 10.0 |
| CHROMATE LAYER COMPOSITION | Cr MAXIMUM CONCENTRATION AND Ni CONTENT | Cr: 40 at% Ni CONTENT: NO | Cr: ABOUT 30 at% Ni CONTENT: ABOUT 10 at% | | | | | | | | | | — |
| | FILM THICKNESS (nm) | 10 | 0.5 | 1 | 2 | 5 | 10 | 20 | 40 | 45 | 50 | 100 | 300 |
| | Cr WEIGHT (μg/cm2) | 1.0 | 0.05 | 0.1 | 0.2 | 0.5 | 1.0 | 2.0 | 4.0 | 4.5 | 5.0 | 10.0 | — |
| STRESS CORROSION CRACKING RESISTANCE | | × | × | × | ○ | ◎ | ◎ | ☆ | ☆ | ☆ | × | × | — |
| SALT RESISTANCE | | × | × | × | ○ | ○ | ◎ | ☆ | ☆ | ☆ | ☆ | ☆ | — |

[CRITERIA FOR DETERMINATION]

- STRESS CORROSION CRACKING RESISTANCE (TIME TO OCCURRENCE OF CRACKING IN GROOVE PORTION)
  - ☆: OVER 80 hrs.
  - ◎: 50 TO 80 hrs.
  - ○: 20 TO 50 hrs.
  - ×: WITHIN 20 hrs.
- CORROSION RESISTANCE (48 HOURS AFTER SALT WATER SPRAY)
  - ☆: RED RUST OCCURRENCE: NO
  - ◎: RED RUST OCCURRENCE: WITHIN 5%
  - ○: RED RUST OCCURRENCE: WITHIN 10%
  - ×: RED RUST OCCURRENCE: OVER 10%

EXAMPLE OF CONCENTRATION DISTRIBUTIONS OF RESPECTIVE ELEMENTS IN THICKNESS DIRECTION OF CHROMATE LAYER

FIG. 6

EFFECTS OF Cu WEIGHT IN CHROMATE LAYER

| | SAMPLE No. | S21 | S22 | S23 | S24 (S07) | S25 | S26 | S27 | S28 |
|---|---|---|---|---|---|---|---|---|---|
| CHROMATE PROCESSING CONDITION | BICHROMATE CONCENTRATION (g/L) | 40 | | | | | | | |
| | PROCESSING TIME (min.) | 5 | | | | | | | |
| | PROCESSING TEMPERATURE (°C) | 35 | | | | | | | |
| | CATHODE CURRENT DENSITY (A/dm2) | 0.2 | | | | | | | |
| | Cu ADDITIVE AMOUNT IN CHROMATE PROCESSING LIQUID (ppm) | 0 | 0.02 | 0.05 | 0.1 | 0.2 | 0.5 | 1.0 | 2.0 |
| CHROMATE LAYER COMPOSITION | Cr MAXIMUM CONCENTRATION AND Ni CONTENT | Cr: ABOUT 30 at%<br>Ni CONTENT: ABOUT 10 at% | | | | | | | |
| | FILM THICKNESS (nm) | 20 | | | | | | | |
| | Cr WEIGHT (μg/cm2) | 2.0 | | | | | | | |
| | Cu WEIGHT (μg/cm2) | 0 | 0.02 | 0.05 | 0.1 | 0.2 | 0.5 | 1.0 | 2.0 |
| APPEARANCE | | ☆ | ☆ | ☆ | ☆ | ☆ | ◎ | ○ | ○ |
| PLATING PEELING RESISTANCE | | ○ | ○ | ◎ | ☆ | ☆ | ☆ | ☆ | ○ |

[CRITERIA FOR DETERMINATION]

· APPEARANCE

☆: EXCELLENT GLOSS

◎: STAIN OCCURRENCE AREA: WITHIN 5%

○: STAIN OCCURRENCE AREA: WITHIN 10%

×: STAIN OCCURRENCE AREA: OVER 10%

· PLATING PEELING RESISTANCE (PLATING STATE IN SWAGED PORTION AFTER SWAGING PROCESS)

☆: NO PLATING LIFTING, NO PLATING PEELING

◎: PLATING LIFTING OCCURRENCE AREA: WITHIN 5%

○: PLATING LIFTING OCCURRENCE AREA: WITHIN 10%

×: PLATING LIFTING: OVER 10%, OCCURRENCE OF PLATING PEELING

FIG. 7

EFFECTS OF Ni WEIGHT IN CHROMATE LAYER

| | SAMPLE No. | S31 | S32 | S33 | S34 (S07) | S35 | S36 | S37 | S38 |
|---|---|---|---|---|---|---|---|---|---|
| CHROMATE PROCESSING CONDITION | BICHROMATE CONCENTRATION (g/L) | 20 | 23 | 27 | 40 | 60 | 63 | 67 | 70 |
| | PROCESSING TIME (min.) | 5 | | | | | | | |
| | PROCESSING TEMPERATURE (°C) | 35 | | | | | | | |
| | CATHODE CURRENT DENSITY (A/dm2) | 0.2 | | | | | | | |
| CHROMATE LAYER COMPOSITION | Cr MAXIMUM CONCENTRATION | Cr: ABOUT 30 at% | | | | | | | |
| | FILM THICKNESS (nm) | 20 | | | | | | | |
| | Cr WEIGHT (μg/cm2) | 2.0 | | | | | | | |
| | Ni WEIGHT (μg/cm2) | 60 | 70 | 80 | 120 | 180 | 190 | 200 | 210 |
| STRESS CORROSION CRACKING RESISTANCE | | × | ○ | ☆ | ☆ | ☆ | ◎ | ○ | × |

[CRITERIA FOR DETERMINATION]

- STRESS CORROSION CRACKING RESISTANCE (TIME TO OCCURRENCE OF CRACKING IN GROOVE PORTION)
  - ☆: OVER 80 hrs.
  - ◎: 50 TO 80 hrs.
  - ○: 20 TO 50 hrs.
  - ×: WITHIN 20 hrs.

SPARK PLUG, METAL SHELL FOR SPARK PLUG, AND METHOD OF MANUFACTURING SPARK PLUG

CROSS-REFERENCE TO RELATED PATENT APPLICATIONS

This application is a U.S. National Phase Application under 35 U.S.C. §371 of International Patent Application No. PCT/JP2010/005655, filed Sep. 16, 2010, and claims the benefit of Japanese Patent Application No. 2010-052451, filed Mar. 10, 2010, all of which are incorporated by reference herein. The International Application was published in Japanese on Sep. 15, 2011 as International Publication No. WO/2011/111128 under PCT Article 21(2).

FIELD OF THE INVENTION

The present invention relates to a spark plug for an internal combustion engine, a metal shell for a spark plug, and a method of manufacturing a spark plug.

BACKGROUND OF THE INVENTION

A spark plug, which is used for igniting an internal combustion engine such as a gasoline engine, has a structure comprising an insulator provided on an outer side of a center electrode, a metal shell provided further outside thereof, a ground electrode that is attached to the metal shell and forms a spark discharge gap between itself and the center electrode. The metal shell is generally made of iron-based material such as carbon steel. In many cases, a surface of the metal shell is plated for corrosion protection. A technique that adopts, as a plating layer, a double-layered structure including a Ni plating layer and a chromate layer is known (Patent Document 1). However, inventors of the present application have found that corrosion resistance of a portion deformed during swaging for the spark plug is an important issue even when such a plating layer having two or more layers is adopted. Hereinafter, an exemplary structure of the spark plug and a process for swaging such a spark plug will be first described. Then, a portion of swaging deformation, which causes the issue of corrosion resistance, will be described.

FIG. 1 is a cross-sectional view illustrating a main part of an exemplary structure of a spark plug. The spark plug 100 has a cylindrical metal shell 1, a cylindrical insulator 2 installed in the metal shell 1 such that its tip portion projects therefrom, a center electrode 3 installed in the insulator 2 such that its tip portion projects therefrom, and a ground electrode 4, having one end being coupled to the metal shell 1 and another end being arranged so as to face the tip portion of the center electrode 3. A spark discharge gap g is formed between the ground electrode 4 and the center electrode 3.

The insulator 2 is made of, for example, ceramics sintered body such as alumina and aluminum nitride and has, in its inside, a through hole 6 for installing the center electrode 3 along the axial direction of the insulator 2. A terminal metal piece 13 is inserted into and fixed on the side of one end of the through hole 6. The center electrode 3 is inserted into and fixed on the side of the other end of the through hole 6. A resistor 15 is provided between the terminal metal piece 13 and the center electrode 3 in the through hole 6. Both ends of the resistor 15 are electrically connected to the center electrode 3 and the terminal metal piece 13 through conductive glass seal layers 16, 17, respectively.

The metal shell 1 is made of metal such as carbon steel and is formed in a hollow cylindrical shape. The metal shell 1 serves as a housing of the spark plug 100. Formed on an outer periphery of the metal shell 1 is a thread portion 7 for attaching the spark plug 100 to an engine block that is not shown. It should be noted that a hexagon portion 1*e* serves as a tool engagement portion for engaging a tool such as a spanner and a wrench when attaching the metal shell 1 to the engine block and has a hexagonal cross-sectional shape. A linear packing member 62 is arranged on a rear-side periphery of a flanged projecting portion 2*e* of the insulator 2, which is located between an outer surface of the insulator 2 and an inner surface of an opening of the metal shell 1 on the rear side (upper side in the figure). A filled layer 61 such as talc and a ring-shaped packing 60 are arranged in this order on the further rear side of the linear packing member 62. In an assembling process, the insulator 2 is pushed toward the front side (lower side of the figure) of the metal shell 1. Then, an opening edge on the rear end of the metal shell 1 is swaged inwardly toward the packing 60 (and the projecting portion 2*e* serving as a swaging support portion). As a result, a swaged portion 1*d* is formed and the metal shell 1 is fixed on the insulator 2.

A gasket 30 is inserted at a base end of the thread portion 7 of the metal shell 1. The gasket 30 is a ring-shaped part formed by bending a metal plate material such as carbon steel and is deformed such that it is compressed and crushed in the axial direction thereof between a flanged gas seal portion if on the side of the metal shell 1 and an opening edge of the tapped hole when the thread portion 7 is screwed into a tapped hole of a cylinder head, thereby sealing a gap between the tapped hole and the thread portion 7.

FIG. 2 is an explanatory diagram illustrating an exemplary process of swaging and fixing the metal shell 1 on the insulator 2 (ground electrode 4 is omitted). First of all, for the metal shell 1 shown in FIG. 2(*a*), as illustrated in FIG. 2(*b*), the insulator 2 is inserted through an insertion opening 1*p* (a swaging target portion 200 to be the swaged portion 1*d* is formed) at the rear end of the metal shell 1, where the center electrode 3, the conductive glass seal layers 16 and 17, the resistor 15 and the terminal metal piece 13 are previously installed in the through hole 6 of the insulator 2. The insertion of the insulator 2 allows an engagement portion 2*h* of the insulator 2 and an engagement portion 1*c* of the metal shell 1 to engage with each other through a plate packing member 63.

After that, as illustrated in FIG. 2(*c*), the linear packing member 62 is arranged in the inside of the insertion opening 1p of the metal shell 1. The filled layer 61 such as talc is formed, and furthermore the linear packing member 60 is arranged. Then, the swaging target portion 200 is swaged, by using a swaging mold 111, to an end face 2*n* of the projecting portion 2*e* as a swaging support portion through the linear packing member 62, the filled layer 61, and the linear packing member 60. As a result, the swaged portion 1*d* is formed as illustrated in FIG. 2(*d*). Moreover, the metal shell 1 is swaged to be fixed to the insulator 2. Here, not only the swaged portion 1*d* but also a groove potion 1*h* (see FIG. 1) between the hexagon portion 1*e* and the gas seal portion 1*f* is deformed due to compressive stress at the time of the swaging. The reason is that the swaged portion 1*d* and the groove potion 1*h* are thinnest and thus tend to be deformed in the metal shell 1. It should be noted that the groove potion 1*h* may be referred to as a "thin portion". After the process illustrated in FIG. 2(*d*), the spark discharge gap g is formed by bending the ground electrode 4 toward the center electrode 3. In this manner, the spark plug 100 illustrated in FIG. 1 is completed. It should be noted that the swaging process described with reference to FIG. 2 is cold swaging (refer to Patent Document 2). Thermal swaging (refer to Patent Document 3) also is applicable.

Citation List

Patent Documents

Patent Document 1: JP-A-2002-184552
Patent Document 2: JP-A-2007-141868
Patent Document 3: JP-A-2003-257583
Patent Document 4: JP-A-2007-023333
Patent Document 5: JP-A-2007-270356

Problems to be Solved by the Invention

According to the above-mentioned related art (Patent Document 1), an electrolytic chromate processing, which allows 95% or more by mass of chromium component of a chromate layer to be trivalent chromium, is performed. Its object is to substantially eliminate hexavalent chromium in order to achieve reduction of environmental burdens and improve corrosion resistance to salt water (i.e. salt resistance).

However, as described above, the swaging process causes not only large deformation but also high residual stress in the swaged portion 1*d* and the groove potion 1*h*. Therefore, corrosion resistance in these potions is an important issue. That is, the swaged portion 1*d* and the groove potion 1*h* are characterized by having high residual stress due to the swaging deformation. In particular, in a case where the thermal swaging is used, textural variation due to heating causes increase in hardness. At such the position where the hardness is high and the high residual stress exists, stress corrosion cracking may be caused. The inventors of the present application have found that not only the salt resistance but also stress corrosion cracking resistance is an important issue particularly with regard to the swaged portion 1*d* and the groove potion 1*h* of the spark plug. Such a problem is conspicuous particularly in a case where a metal shell made from a material containing a large amount of carbon (for example, carbon steel containing carbon of 0.15% or more by weight) is used. This problem is conspicuous also in a case where the thermal swaging is used as the swaging process.

An object of the present invention is to provide a spark plug that is excellent not only in the salt resistance but also in the stress corrosion cracking resistance.

SUMMARY OF THE INVENTION

Solutions to the Problems

The present invention has been made for solving at least a part of the above-described problems. The present invention can be achieved as the following modes or examples.

Example 1

A spark plug including a metal shell covered by a composite layer including a nickel plating layer and a chromate layer formed on the nickel plating layer, characterized in that the chromate layer has a film thickness of 2 to 45 nm and Cr element concentration of not more than 60 at % and contains Ni in addition to Cr.

Example 2

The spark plug according to example 1, characterized in that a Cr weight per unit surface area of the metal shell is in a range of 0.5 to 4.5 g/cm$^2$, wherein a surface of the metal shell is dissolved, for 10 minutes, in solution at room temperature obtained by mixture of equal amounts of concentrated hydrochloric acid of 35% concentration and water, and the Cr weight per unit surface area of the metal shell is calculated from Cr concentration in the solution after the dissolution.

Example 3

The spark plug according to example 1 or 2, characterized in that a Cu weight per unit surface area of the metal shell is in a range of 0.05 to 1 μg/cm$^2$, wherein a surface of the metal shell is dissolved, for 10 minutes, in solution at room temperature obtained by mixture of equal amounts of concentrated hydrochloric acid of 35% concentration and water, and the Cu weight per unit surface area of the metal shell is calculated from Cu concentration in the solution after the dissolution.

Example 4

The spark plug according to any one of examples 1 to 3, characterized in that a Ni weight per unit surface area of the metal shell is in a range of 70 to 200 μg/cm$^2$, wherein a surface of the metal shell is dissolved, for 10 minutes, in solution at room temperature obtained by mixture of equal amounts of concentrated hydrochloric acid of 35% concentration and water, and the Ni weight per unit surface area of the metal shell is calculated from Ni concentration in the solution after the dissolution.

Example 5

The spark plug according to any one of examples 1 to 4, characterized in that the film thickness of the chromate layer is in a range of 20 to 45

Example 6

A metal shell for a spark plug that is covered by a composite layer having a nickel plating layer and a chromate layer formed on the nickel plating layer, characterized in that the chromate layer has a film thickness of 2 to 45 nm and Cr element concentration of not more than 60 at % and contains Ni in addition to Cr.

Example 7

The metal shell for a spark plug according to example 6, characterized in that a Cr weight per unit surface area of the metal shell is in a range of 0.5 to 4.5 μg/cm$^2$, wherein a surface of the metal shell is dissolved, for 10 minutes, in solution at room temperature obtained by mixture of equal amounts of concentrated hydrochloric acid of 35% concentration and water, and the Cr weight per unit surface area of the metal shell is calculated from Cr concentration in the solution after the dissolution.

Example 8

The metal shell for a spark plug according to example 6 or 7, characterized in that a Cu weight per unit surface area of the metal shell is in a range of 0.05 to 1 μg/cm$^2$, wherein a surface of the metal shell is dissolved, for 10 minutes, in solution at room temperature obtained by mixture of equal amounts of concentrated hydrochloric acid of 35% concentration and water, and the Cu weight per unit surface area of the metal shell is calculated from Cu concentration in the solution after the dissolution.

Example 9

The metal shell for a spark plug according to any one of examples 6 to 8, characterized in that a Ni weight per unit surface area of the metal shell is in a range of 70 to 200 $\mu g/cm^2$, wherein a surface of the metal shell is dissolved, for 10 minutes, in solution at room temperature obtained by mixture of equal amounts of concentrated hydrochloric acid of 35% concentration and water, and the Ni weight per unit surface area of the metal shell is calculated from Ni concentration in the solution after the dissolution.

Example 10

The metal shell for a spark plug according to any one of examples 6 to 9, characterized in that the film thickness of the chromate layer is in a range of 20 to 45 nm.

Example 11

A method of manufacturing the spark plug according to any one of examples 1 to 5, including sequentially performing nickel plating processing and barrel-type electrolytic chromate processing on the metal shell to form the composite layer having the nickel plating layer and the chromate layer on a surface of the metal shell, characterized in that the barrel-type electrolytic chromate processing is performed under processing conditions of cathode current density of 0.02 to 0.45 $A/dm^2$, processing time of 1 to 10 minutes, and liquid temperature of 20 to 60° C.

It should be noted that the present invention can be achieved in various modes. For example, the present invention can be achieved in modes of a spark plug, a metal shell for the same, a method of manufacturing the same and the like.

EFFECTS OF THE INVENTION

According to the spark plug as described in the example 1, it is possible to provide the spark plug that is excellent in the salt resistance and the stress corrosion cracking resistance.

According to the spark plug as described in the example 2, it is possible to further increase the stress corrosion cracking resistance.

According to the spark plug as described in the example 3, it is possible to provide the spark plug that is excellent not only in the salt resistance and the stress corrosion cracking resistance but also in plating layer peeling resistance and appearance.

According to the spark plug as described in the example 4, it is possible to further increase the stress corrosion cracking resistance.

According to the metal shell for a spark plug as described in the example 5, it is possible to maximize both the salt resistance and the stress corrosion cracking resistance.

According to the metal shell for a spark plug as described in the example 6, it is possible to provide the metal shell for the spark plug that is excellent in the salt resistance and the stress corrosion cracking resistance.

According to the metal shell for a spark plug as described in the example 7, it is possible to further increase the stress corrosion cracking resistance.

According to the metal shell for a spark plug as described in the example 8, it is possible to provide the metal shell for the spark plug that is excellent not only in the salt resistance and the stress corrosion cracking resistance but also in plating layer peeling resistance and appearance.

According to the metal shell for a spark plug as described in the example 9, it is possible to further increase the stress corrosion cracking resistance.

According to the metal shell for a spark plug as described in the example 10, it is possible to maximize both the salt resistance and the stress corrosion cracking resistance.

BRIEF DESCRIPTION OF THE DRAWINGS

These and other features and advantages of the present invention will become more readily appreciated when considered in connection with the following detailed description and appended drawings, wherein like designations denote like elements in the various views, and wherein:

FIG. 4 is an explanatory diagram showing an experimental result with regard to effects of the film thickness and Cr weight of a chromate layer on corrosion resistance of the metal shell.

FIG. 6 is an explanatory diagram showing an experimental result with regard to effects of Cu weight in the chromate layer on appearance and the plating peeling resistance of the metal shell.

FIG. 7 is an explanatory diagram showing an experimental result with regard to effects of Ni weight in the chromate layer on the stress corrosion cracking resistance of the metal shell.

DETAILED DESCRIPTION OF THE INVENTION

Description of Embodiments

Figure 1:
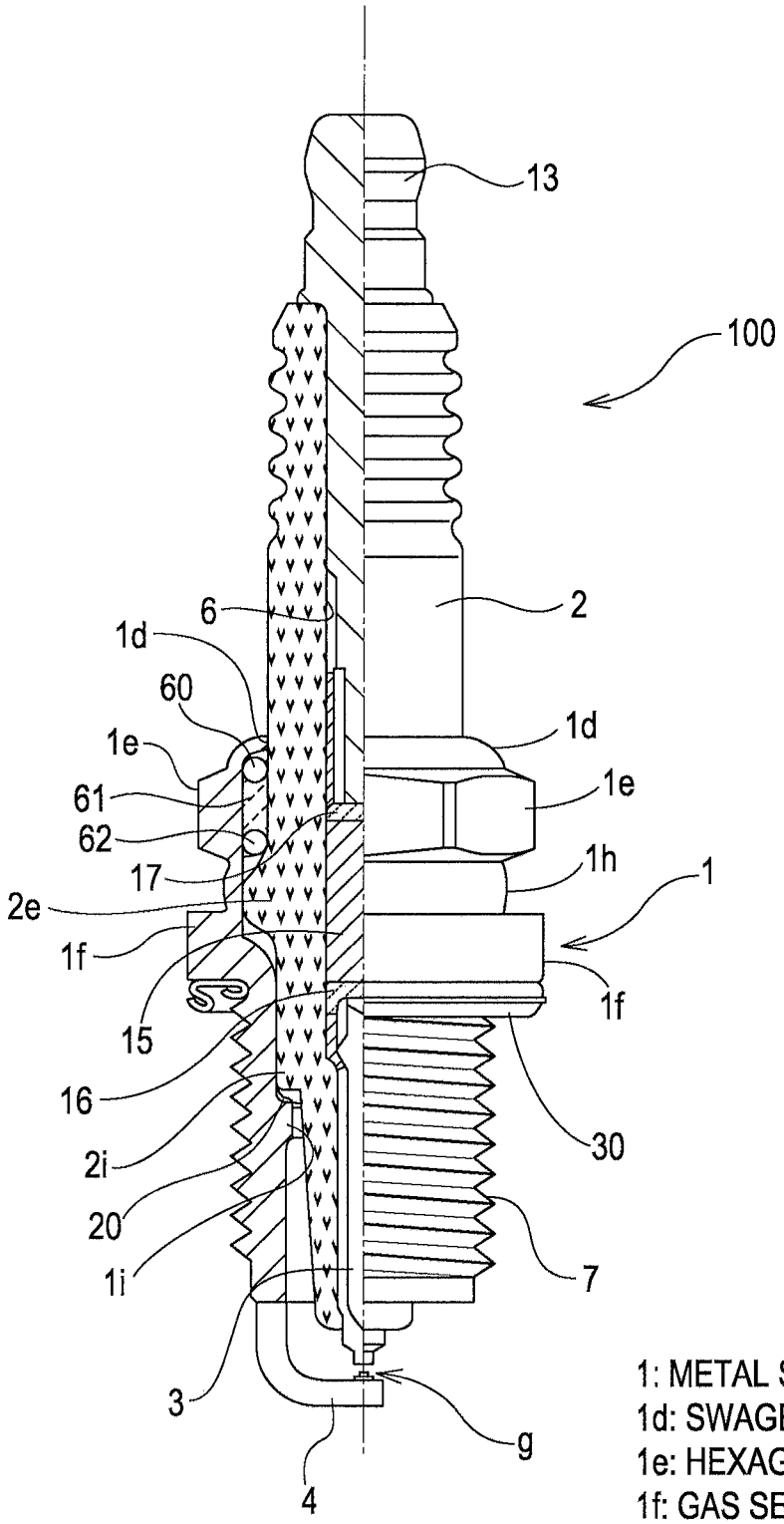
FIG. 1 is a cross-sectional view illustrating a main part of an exemplary structure of a spark plug.
Figure 2:
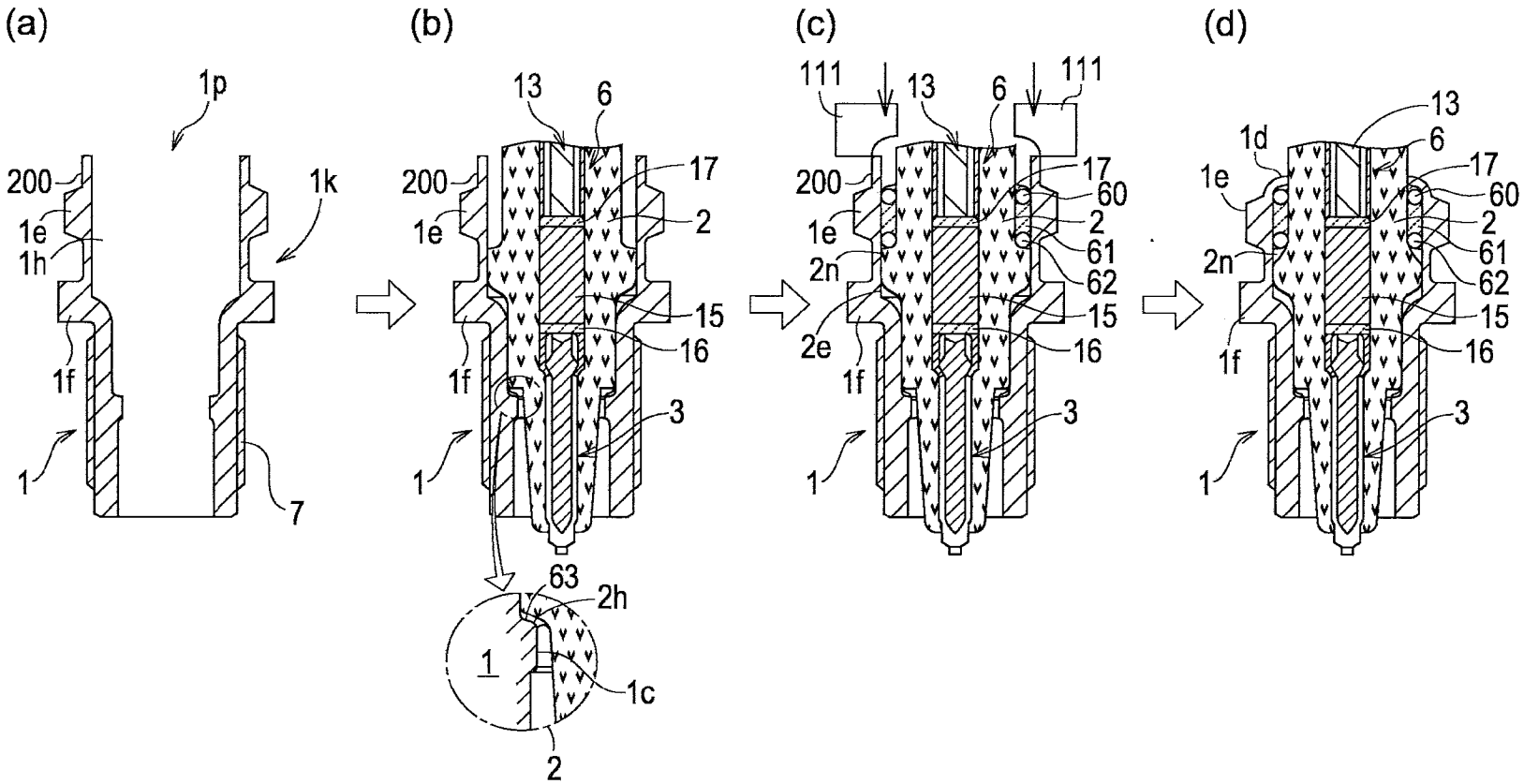
FIG. 2 is an explanatory diagram illustrating an exemplary swaging process for fixing a metal shell to an insulator.
Figure 3:
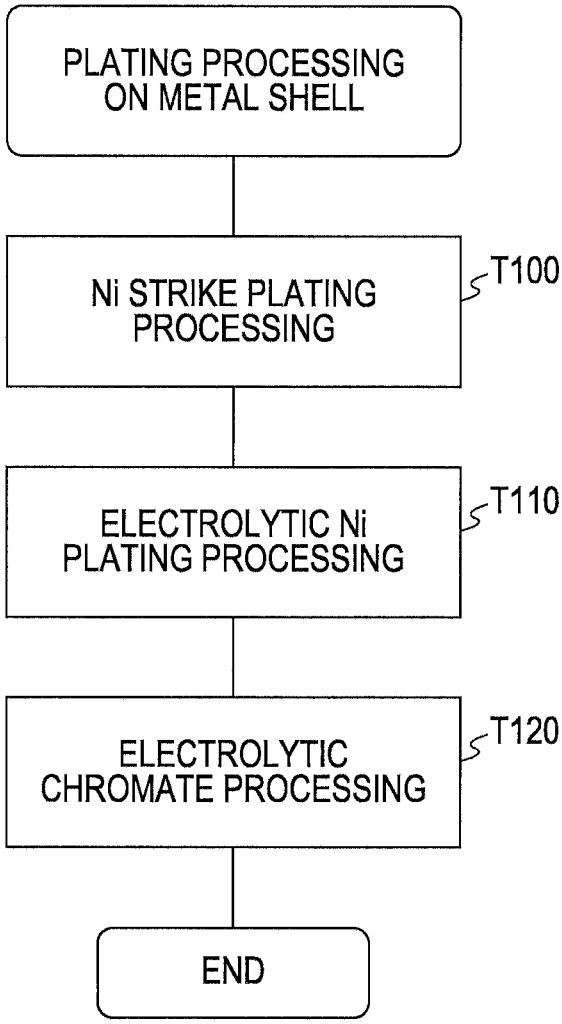
FIG. 3 is a flow chart showing a procedure of plating processing with respect to the metal shell.

A spark plug as an embodiment of the present invention has a configuration as illustrated in FIG. 1. Since this configuration is previously described, the description is omitted here. The spark plug 100 is manufactured, for example, by fixing the metal shell 1 and the insulator 2 in accordance with the swaging process as illustrated in FIG. 2. Plating processing is performed with respect to the metal shell 1 before the swaging process, FIG. 3 is a flow chart showing a procedure of the plating processing on the metal shell. In Step T100, nickel strike plating is performed. The nickel strike plating is performed for cleaning a surface of the metal shell formed from carbon steel and for improving adhesion of the plating to base metal. However, the nickel strike plating may be omitted. Common processing conditions can be used as processing conditions for the nickel strike plating. An example of preferable specific processing conditions is as follows.

<Example of Processing Conditions for Nickel Strike Plating> plating bath composition:

nickel chloride: 150 to 600 g/L

35% hydrochloric acid: 50 to 300 ml/L solvent: deionized water processing temperature (bath temperature): 25 to 40° C.

cathode current density: 0.2 to 0.4 $A/dm^2$ processing time: 5 to 20 minutes

In Step T110, electrolytic nickel plating processing is performed. As the electrolytic nickel plating processing, barrel-type electrolytic nickel plating processing that uses a rotating barrel can be utilized. Alternatively, another plating processing method such as a vat plating method may be utilized. Common processing conditions can be used as processing conditions for the electrolytic nickel plating. An example of preferable specific processing conditions is as follows.

<Example of Processing Conditions for Electrolytic Nickel Plating> plating bath composition:
nickel sulfate: 100 to 400 g/L
nickel chloride: 20 to 60 g/L
boric acid: 20 to 60 g/L
solvent: deionized water
bath pH: 2.0 to 4.8
processing temperature (bath temperature): 25 to 60° C.
cathode current density: 0.2 to 0.4 A/dm$^2$
processing time: 40 to 80 minutes In Step T120, electrolytic chromate processing is performed. A rotating barrel can be utilized also in the electrolytic chromate processing. Alternatively, another plating processing method such as a vat plating method may be utilized. An example of preferable processing conditions for the electrolytic chromate processing is as follows.

<Example of Processing Conditions for Electrolytic Chromate Processing> processing bath (chromate processing liquid) composition:
sodium bichromate: 20 to 70 g/L
solvent: deionized water
bath pH: 2 to 6
processing temperature (bath temperature): 20 to 60° C.
cathode current density: 0.02 to 0.45 A/dm$^2$ (preferably 0.1 to 0.45 A/dm$^2$ in particular)
processing time: 1 to 10 minutes It should be noted that potassium bichromate as well as sodium bichromate can be utilized as the bichromate. The combination of other processing conditions (the amount of bichromate, the cathode current density, the processing time, and the like) can be different from those described above, depending on a desirable film thickness of the chromate layer. It should be noted that desirable processing conditions for the chromate processing will be described later along with experimental results.

As a result of the above-mentioned plating processing, a coating film of a double-layered structure composed of the nickel plating layer and the chromate layer is formed on an exterior surface and an interior surface of the metal shell. Another protective coating film may be further formed thereon. In this manner, a protective coating film having a multi-layered structure is formed. After that, the metal shell is fixed to the insulator and the like by the swaging process. In this manner, the spark plug is manufactured. Thermal swaging as well as cold swaging can be utilized as the swaging process.

EXAMPLES

The metal shell 1 was manufactured by cold forging using cold heading carbon steel wire SWCH17K defined in JISG3539 as a material. The ground electrode 4 was connected to the metal shell 1 by welding, and then degreasing and water washing were performed. After that, the nickel strike plating processing using a rotating barrel was performed under the following processing conditions.

<Processing Conditions for Nickel Strike Plating> plating bath composition:
nickel chloride: 300 g/L
35% hydrochloric acid: 100 ml/L
processing temperature (bath temperature): 30±5° C.
cathode current density: 0.3 A/dm$^2$
processing time: 15 minutes Next, the electrolytic nickel plating processing was performed using a rotating barrel under the following processing conditions. As a result, a nickel plating layer was formed.

<Processing Conditions for Electrolytic Nickel Plating> plating bath composition:
nickel sulfate: 250 g/L
nickel chloride: 50 g/L
boric acid: 40 g/L
bath pH: 3.7
processing temperature (bath temperature): 55±5° C.
cathode current density: 0.3 A/dm$^2$
processing time: 60 minutes Next, the electrolytic chromate processing was performed using a rotating barrel under the following processing conditions. As a result, a chromate layer was formed on the nickel plating layer.

<Processing Conditions for Electrolytic Chromate Processing> processing bath (chromate processing liquid) composition:
sodium bichromate: 10 g/L or 40 g/L
solvent: deionized water
processing temperature (bath temperature): 35±5° C.
cathode current density: 0.005 A/dm$^2$ to 1 A/dm$^2$
processing time: 5 minutes FIG. 4 is an explanatory diagram showing the chromate processing conditions, composition of the chromate layer, and experimental results of the corrosion resistance (stress corrosion cracking resistance and salt resistance) with regard to eleven samples S01 to S11 manufactured under the above-described processing conditions. Effects of the film thickness and Cr weight of the chromate layer on the corrosion resistance of the metal shell can be primarily seen from FIG. 4, which will be described later. Regarding the sample S01 among the eleven samples S01 to S11, concentration of bichromate (sodium bichromate) is 10 g/L. Regarding the other ten samples S02 to S11, the concentration is 40 g/L. Moreover, regarding the samples S02 to S11, the cathode current density was set to respectively different values within a range of 0.005 to 1 A/dm$^2$ in order to control the film thickness of the chromate layer. On the other hand, regarding the sample S01, the cathode current density was set to 0.1 A/dm$^2$. It should be noted that the processing conditions for the nickel strike plating and the electrolytic nickel plating were the same among all the samples.

Regarding the samples S01 to S11, thickness measurement and composition analysis with respect to the chromate layer were performed and further, an evaluation test regarding the stress corrosion cracking resistance and an evaluation test regarding the salt resistance were performed.

In the thickness measurement with respect to the chromate layer, a small piece was first cut out from vicinity of an external surface of each sample by using focused ion beam processing equipment (FIB processing equipment). Then, the small piece was analyzed using a scanning transmission electron microscope (STEM) at an acceleration voltage of 200 kV. Thereby, a color map image of Cr element regarding the vicinity of the external surface in the cross-section (cross-section perpendicular to a central axis represented by a dashed-dotted line in FIG. 1) of the metal shell was obtained. Then, the film thickness of the chromate layer was measured based on the obtained color map image.

In the composition analysis with respect to the chromate layer, Cr maximum concentration (the maximum value of the atomic concentration of Cr) and the atomic concentration of Ni at the position where the concentration of Cr is the maximum were measured by using an X-ray photoelectron spectrometer (XPS) under a beam diameter ϕ of 50 μm, a signal acceptance angle of 45° and pass energy of 280 eV.

Figure 5:
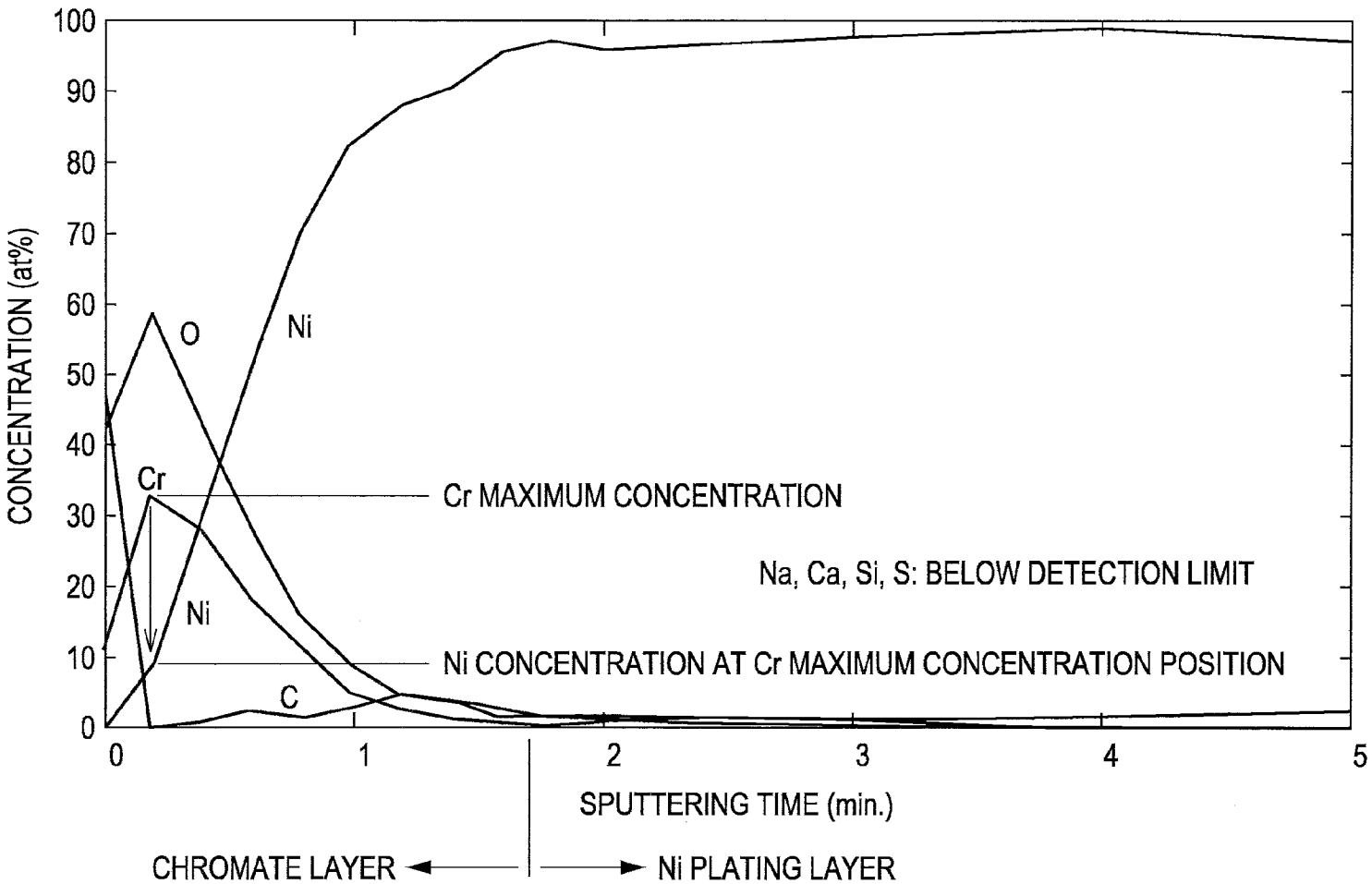
FIG. 5 is a graph showing an example of concentration distributions of respective elements in the thickness direction of the chromate layer.

FIG. 5 is a graph showing exemplary concentration distributions of respective elements in the thickness direction of the chromate layer, where the concentration distributions were measured using the XPS. The horizontal axis represents a sputtering time. A position corresponding to the sputtering time=0 is the surface of the double-layered coating film. The vertical axis represents the atomic concentration (at %). The chromate layer includes chromium (Cr), nickel (Ni), and oxygen (O). Moreover, carbon (C) was detected near the surface of the chromate layer. The carbon may be caused by some contamination. The chromium concentration exhibits the maximum value at a depth position slightly inward of the surface of the chromate layer. The atomic concentration of chromium at this position is denoted as the "Cr maximum concentration" in FIG. 4. The Cr maximum concentration was about 40 at % for the sample S01. On the other hand, values of about 30 at % were obtained for the samples S02 to S11. A region to a depth position where the chromium concentration becomes almost 0 corresponds to the chromate layer. A region at a deeper position corresponds to the nickel plating layer. The nickel concentration is 0 at the surface of the chromate layer and increases with increasing depth from the surface. The nickel concentration at the depth position corresponding to the Cr maximum concentration is indicated in a column of "Cr maximum concentration and Ni content" in FIG. 4. In the cases of the samples S02 to S11, the nickel concentration at the depth position corresponding to the Cr maximum concentration was near 10 at %. On the other hand, for the sample S01, the nickel concentration in the chromate layer was at a negligible level. It should be noted that, in the cases of the samples S02 to S11, a fair amount of nickel is included in the chromate layer as can be seen from FIG. 5. It was found that if a sufficient amount of nickel was included in the chromate layer, the salt resistance and the stress corrosion cracking resistance of the chromate layer were improved even if the film thickness was the same, which will be described later. It should be noted that the Cr maximum concentration in the chromate layer is usually equal to or less than 60 at %. The Cr maximum concentration is preferably equal to or less than 40 at % in order that a sufficient amount of Ni is included in the chromate layer.

As the composition analysis with respect to the chromate layer, Cr weight per unit surface area of the metal shell was further calculated by dissolving a coating surface film of the sample (metal shell) and then measuring the concentration of chromium (Cr) in the solution. More specifically, solution was first prepared by mixing concentrated hydrochloric acid of 35% concentration and deionized water at a volume ratio of 1:1. The surface of the sample (metal shell) was dissolved in this solution. At this time, the solution temperature was set to room temperature and dissolution time was set to 10 minutes. Then, element concentration in the solution after the dissolution was analyzed using ICP mass analysis equipment. Based on the concentration thus measured, the weight of chromium (Cr) in the solution was calculated. The calculated weight was divided by a surface area (external surface area plus internal surface area) of the metal shell. In this manner, the Cr weight per unit surface area of the metal shell was calculated. The surface area of the metal shell was calculated by measuring the size of each portion of the metal shell, using the measured values to create a plurality of CAD diagrams including the cross-sectional diagram (FIG. 2(*a*)), and then, calculating a surface area of a rotating body of the cross-section as the surface area of the metal shell. Here, regarding the thread portion 7, approximation was made by using a rotating body of concavo-convex cross-section of a thread of a screw. It should be noted that the surface area of the hexagon portion 1*e* was calculated based on the three-dimensional CAD diagram of the metal shell, instead of the value calculated by using the rotating body. In this dissolution processing, at least whole of the chromate layer appears to be dissolved. Moreover, for the sample having a thin chromate layer, a part of the nickel plating layer appears to be dissolved as well. The Cr weight per unit surface area was 1 μg/cm$^2$ for the sample S01 and 0.05 to 10 μg/cm$^2$ for the samples S02 to S11. It should be noted that the value of the Cr weight of each sample shown in FIG. 4 is an average of values respectively obtained by dissolving five metal shells which were manufactured under the same processing conditions.

As an evaluation test with respect to the stress corrosion cracking resistance of the samples S01 to S11, the following accelerated corrosion test was performed. First, four holes each having the diameter of about 2 mm were formed in the groove potion 1*h* (see FIG. 1) of each sample (metal shell). After that, the insulator and the like were fixed by the swaging. The reason why the holes were made is to cause a test corrosive solution to penetrate inside of the metal shell. Test conditions of the accelerated corrosion test are as follows.

<Test Conditions for Accelerated Corrosion Test (Evaluation Test for Stress Corrosion Cracking Resistance)> corrosive solution composition:
calcium nitrate tetrahydrate: 1036 g
ammonium nitrate: 36 g
potassium permanganate: 12 g
pure water: 116 g
pH: 3.5 to 4.5
processing temperature: 30±10° C.

The reason why potassium permanganate as oxidant is mixed in the corrosive solution is to accelerate the corrosion test.

After the test was performed under such conditions for 10 hours, the sample was taken out, its groove potion 1*h* was externally observed by using a magnifying glass, and whether or not cracking occurred in the groove potion 1*h* was investigated. If cracking was not generated, the corrosive solution was replaced and another accelerated corrosion test was further performed under the same conditions for additional 10 hours. Such the test was repeated until the total test time reached 80 hours. The high residual stress was caused in the groove potion 1*h* as a result of the swaging process. Therefore, the stress corrosion cracking resistance in the groove potion 1*h* can be evaluated by the accelerated corrosion test. In the cases of the samples S01, S02, S03, S10, and S11, cracking occurred in the groove potion 1*h* before the total test time exceeded 20 hours. For the sample S04, cracking occurred in the groove potion 1*h* after the total test time exceeded 20 hours and before the total test time reached 50 hours. In the cases of the samples S05 and S06, cracking occurred in the groove potion 1*h* after the total test time exceeded 50 hours and before the total test time reached 80 hours. In the cases of the samples S07, S08 and S09, cracking was not generated in the groove potion 1*h* even when the total test time reached 80 hours. From a point of view of the stress corrosion cracking resistance, the film thickness of the chromate layer is preferably in a range of 2 to 45 nm, more preferably in a range of 5 to 45 nm, and most preferably in a range of 20 to 45 nm. The Cr weight per unit surface area of the metal shell is preferably in a range of 0.2 to 4.5 μg/cm$^2$, more preferably in a range of 0.5 to 4.5 μg/cm$^2$, and most preferably in a range of 2.0 to 4.5 μg/cm$^2$. The cathode current density at the time of the chromate processing is preferably in a range of 0.02 to 0.45 A/dm$^2$, more preferably in a range of 0.05 to 0.45 A/dm$^2$, and most preferably in a range of 0.2 to 0.45 A/dm$^2$.

As an evaluation test with respect to the salt resistance of the samples S01 to S11, a neutral salt water spray test defined in JIS H8502 was performed. In the test, a ratio of a red rust occurrence area to the surface area of the metal shell of the sample was measured after the salt water spray test was performed for 48 hours. A value of the occurrence area ratio was obtained as follows. First, a picture of the sample after the test was taken. An area Sa of a part where red rust was caused in the picture and an area Sb of the metal shell in the picture were measured. Then, a ratio of them Sa/Sb was calculated as the red rust occurrence area ratio. For the samples S01, S02, and S03, the red rust occurrence area ratio was more than 10%. For the samples S04 and S05, the red rust occurrence area ratio was more than 5% and not more than 10%. For the sample S06, the red rust occurrence area ratio was more than 0% and not more than 5%. For the samples S07 to S11, no red rust was caused. From a point of view of the salt resistance, the film thickness of the chromate layer is preferably in a range of 2 to 100 nm, more preferably in a range of 10 to 100 nm, and most preferably in a range of 20 to 100 nm. The Cr weight per unit surface area of the metal shell is preferably in a range of 0.2 to 10 μg/cm$^2$, more preferably in a range of 1.0 to 10 μg/cm$^2$, and most preferably in a range of 2.0 to 10 μg/cm$^2$. The cathode current density at the time of the chromate processing is preferably in a range of 0.02 to 1 A/dm$^2$, more preferably in a range of 0.1 to 1 A/dm$^2$, and most preferably in a range of 0.2 to 1 A/dm$^2$, When considering both the stress corrosion cracking resistance and the salt resistance, the film thickness of the chromate layer is preferably in a range of 2 to 45 nm, more preferably in a range of 10 to 45 nm, and most preferably in a range of 20 to 45 nm, The Cr weight per unit surface area of the metal shell is preferably in a range of 0.2 to 4.5 μg/cm$^2$, more preferably in a range of 1.0 to 4.5 μg/cm$^2$, and most preferably in a range of 2.0 to 4.5 μg/cm$^2$. The cathode current density at the time of the chromate processing is preferably in a range of 0.02 to 0.45 A/dm$^2$, more preferably in a range of 0.1 to 0.45 A/dm$^2$, and most preferably in a range of 0.2 to 0.45 A/dm$^2$.

It should be noted that, in order to obtain the various results shown in FIG. 4, the above-described measurement and test were performed on a plurality of samples manufactured under the same chromate processing conditions. The results shown in FIG. 4 are obtained by summarizing results of the measurements and the tests under the respective chromate processing conditions.

The rightmost column of FIG. 4 indicates, as a reference, the film thickness of the chromate layer of a sample S12, on which the chromate processing was performed on under conditions of the amount of sodium bichromate of 34 g/L (solvent was deionized water), the processing time of 1.5 minute, the processing temperature of 30° C., and the cathode current density of 10 A/dm$^2$. For the sample S12, the film thickness of the chromate layer, which was 300 nm, was extremely large and deviated greatly from the above-mentioned preferable range of the film thickness. From a point of view of the results with respect to the samples S10 and S11, it is assumed that at least the stress corrosion cracking resistance is insufficient for the sample S12.

FIG. 6 is an explanatory diagram showing an experimental result with regard to effects of Cu weight in the chromate layer on appearance and plating peeling resistance of the metal shell. The samples S21 to S28 shown in FIG. 6 were obtained under the same chromate processing conditions as the ones used for the sample S07 shown in FIG. 4 except for the Cu additive amount in the chromate processing liquid. The Cu additive amount was adjusted by adding copper chloride to the chromate processing liquid. The processing conditions for the nickel strike plating and the electrolytic nickel plating were the same as those for the sample S07. It should be noted that the sample S24 was manufactured under the same chromate processing conditions as those for the sample S07, Regarding the samples S21 to S28, Cu weight per unit surface area of the metal shell was measured as well. A method of measuring thereof was the same as the method of measuring the Cr weight per unit surface area that is described with regard to FIG. 4. In the cases of the samples S21 to S28, the Cu weight per unit surface area of the metal shell was in a range of 0 to 2.0 μg/cm$^2$.

Appearance inspection and plating peeling resistance test were performed with respect to the samples S21 to S28. In the appearance inspection, a ratio of a stain occurrence area to the surface area of the metal shell after the chromate processing was measured. The measurement was made by using a picture, as in the case of the measurement of the red rust occurrence area ratio described above. In the cases of the samples S21 to S25, excellent gloss was obtained over the entire metal shell and the stain occurrence area ratio was less than 5%. For the sample S26, the stain occurrence area ratio was more than 0% and not more than 5%. In the cases of the samples S27 and S28, the stain occurrence area ratio was more than 5% and not more than 10%. There is no sample for which the stain occurrence area ratio was more than 10%. With respect to the appearance of the metal shell, the Cu weight per unit surface area is preferably in a range of 0 to 2 μg/cm$^2$, more preferably in a range of 0 to 0.5 μg/cm$^2$, and most preferably in a range of 0 to 0.2 μg/cm$^2$.

In the plating peeling resistance test, the chromate processing was performed on the metal shell of each sample, followed by fixing the insulator and the like by the swaging process and observing a plating state in the swaged portion 1*d* to make a determination. More specifically, a ratio of an area where plating lifting occurs (hereinafter referred to as a "plating lifting area") to the surface area of the swaged portion 1*d* was measured. The measurement was made by using a picture, as in the case of the measurement of the red rust occurrence area ratio described above. In the cases of the samples S24 to S27, neither the plating lifting nor the plating peeling was observed. For the sample S23, the plating lifting occurrence area ratio was less than 5%. In the cases of the samples S21, S22, and S28, the plating lifting occurrence area ratio was more than 5% and not more than 10%. There was no sample for which the plating lifting occurrence area ratio was more than 10% or the plating peeling occurred. With respect to the plating peeling resistance, the Cu weight, per unit surface area of the metal shell is preferably in a range of 0 to 2 μg/cm$^2$, more preferably in a range of 0.05 to 1.0 μg/cm$^2$, and most preferably in a range of 0.1 to 1.0 μg/cm$^2$.

When considering both the appearance and the plating peeling resistance, the Cu weight per unit surface area of the metal shell is preferably in a range of 0 to 2 μg/cm$^2$, more preferably in a range of 0.05 to 0.5 μg/cm$^2$, and most preferably in a range of 0.1 to 0.2 μg/cm$^2$.

FIG. 7 is an explanatory diagram showing an experimental result with regard to effects of Ni weight in the chromate layer on the stress corrosion cracking resistance of the metal shell. The samples S31 to S38 shown in FIG. 7 were obtained under the same chromate processing conditions as the ones used for the sample S07 shown in FIG. 4 except for the concentration of bichromate (sodium bichromate). The processing conditions for the nickel strike plating and the electrolytic nickel plating were the same as those for the sample S07. It should be noted that the sample S34 was manufactured under the same chromate processing conditions as those for the sample S07. Regarding the samples S31 to S38, Ni weight per unit surface area of the metal shell of the sample was measured as well. A method of measuring thereof is the same as the method of measuring the Cr weight per unit surface area described above. In the cases of the samples S31 to S38, the Ni weight per unit surface area of the metal shell was in a range of 60 to 210 μg/cm$^2$. It should be noted that the Ni weight in the chromate layer can be adjusted by adjusting the amount of bichromate put into the chromate processing liquid, as can be seen from these examples.

The above-described evaluation test for the stress corrosion cracking resistance was performed with respect to the samples S31 to S38. In the cases of the samples S31 and S38, cracking occurred in the groove potion 1*h* before the total test time exceeded 20 hours. In the cases of the samples S32 and S37, cracking occurred in the groove potion 1*h* after the total test time exceeded 20 hours and before the total test time reached 50 hours. For the sample S36, cracking occurred in the groove potion 1*h* after the total test time exceeded 50 hours and before the total test time reached 80 hours. In the cases of the samples S33, S34, and S35, cracking was not generated in the groove potion 1*h* even when the total test time reached 80 hours. From a point of view of the stress corrosion cracking resistance, the Ni weight per unit surface area of the metal shell is preferably in a range of 70 to 200 μg/cm$^2$, more preferably in a range of 80 to 190 μg/cm$^2$, and most preferably in a range of 80 to 180 μg/cm$^2$. It should be noted that the concentration of bichromate (sodium bichromate) in the chromate processing liquid is preferably in a range of 23 to 67 g/L, more preferably in a range of 27 to 63 g/L, and most preferably in a range of 27 to 60 g/L.

DESCRIPTION OF REFERENCE SIGNS

1 metal shell
1*c* engagement portion
1*d* swaged portion
1*e* hexagon portion
1*f* gas seal portion (flange portion)
1*h* groove potion (thin portion)
1*p* insertion opening
2 insulator
2*e* projecting portion
2*h* engagement portion
2*n* end face
3 center electrode
4 ground electrode
6 through hole
7 thread portion
13 terminal metal piece
15 resistor
16, 17 conductive glass seal layer
30 gasket
60 linear packing member
61 filled layer
62 linear packing member
63 plate packing member
100 spark plug
111 mold
200 swaging target portion

The invention claimed is:

1. A spark plug comprising a metal shell covered by a composite layer including a nickel plating layer and a chromate layer formed on the nickel plating layer, wherein the chromate layer has a film thickness of 2 to 45 nm and a Cr element concentration of not more than 60 at % and contains Ni in addition to Cr.

2. The spark plug according to claim 1, wherein the metal shell has a Cr weight per unit surface area in a range of 0.5 to 4.5 μg/cm$^2$, and wherein the Cr weight per unit surface area is calculated based on Cr concentration that is obtained by dissolving a surface of the metal shell in a solution containing equal amounts of 35% concentrated hydrochloric acid and water at room temperature for 10 minutes.

3. The spark plug according to claim 1, wherein the metal shell has a Cu weight per unit surface area in a range of 0.05 to 1 μg/cm$^2$, and wherein the Cu weight per unit surface area is calculated based on Cu concentration that is obtained by dissolving a surface of the metal shell in a solution containing equal amounts of 35% concentrated hydrochloric acid and water at room temperature for 10 minutes.

4. The spark plug according claim 1, wherein the metal shell has a Ni weight per unit surface area in a range of 70 to 200 μg/cm$^2$, wherein the Ni weight per unit surface area is calculated based on Ni concentration that is obtained by dissolving a surface of the metal shell in a solution containing equal amounts of 35% concentrated hydrochloric acid and water at room temperature for 10 minutes.

5. The spark plug according to claim 1, wherein the film thickness of the chromate layer is in a range of 20 to 45 nm.

6. A metal shell for a spark plug, said metal shell being covered by a composite layer having a nickel plating layer and a chromate layer formed on the nickel plating layer, wherein the chromate layer has a film thickness of 2 to 45 nm and Cr element concentration of not more than 60 at % and contains Ni in addition to Cr.

7. The metal shell for a spark plug according to claim 6, having a Cr weight per unit surface area in a range of 0.5 to 4.5 μg/cm$^2$, wherein the Cr weight per unit surface area is calculated based on Cr concentration that is obtained by dissolving a surface of the metal shell in a solution containing equal amounts of 35% concentrated hydrochloric acid and water at room temperature for 10 minutes.

8. The metal shell for a spark plug according to claim 6, having a Cu weight per unit surface area in a range of 0.05 to 1 μg/cm$^2$, wherein the Cu weight per unit surface area is calculated based on Cu concentration that is obtained by dissolving a surface of the metal shell in a solution containing equal amounts of 35% concentrated hydrochloric acid and water at room temperature for 10 minutes.

9. The metal shell for a spark plug according to claim 6, having a Ni weight per unit surface area in a range of 70 to 200 μg/cm$^2$, wherein the Ni weight per unit surface area is calculated based on Ni concentration that is obtained by dissolving a surface of the metal shell in a solution containing equal amounts of 35% concentrated hydrochloric acid and water at room temperature for 10 minutes.

10. The metal shell for a spark plug according to claim 6, having the film thickness of the chromate layer in a range of 20 to 45 nm.

11. A method of manufacturing the spark plug according to claim 1, comprising the steps of:

sequentially performing nickel plating processing and barrel-type electrolytic chromate processing on the metal shell; and forming the composite layer having the nickel plating layer and the chromate layer on a surface of the metal shell, wherein the barrel-type electrolytic chromate processing is performed under processing conditions of cathode current density of 0.02 to 0.45 $A/dm^2$, processing time of 1 to 10 minutes, and liquid temperature of 20 to 60° C.

* * * * *